US007300260B1

(12) United States Patent
Gandrud

(10) Patent No.: US 7,300,260 B1
(45) Date of Patent: Nov. 27, 2007

(54) SPECIAL FLUIDS FOR USE IN A HYDROSTATIC TRANSMISSION

(75) Inventor: Michael D Gandrud, Ames, IA (US)

(73) Assignee: Sauer-Danfoss Inc., Ames, IA (US)

( * ) Notice: Subject to any disclaimer, the term of this patent is extended or adjusted under 35 U.S.C. 154(b) by 652 days.

(21) Appl. No.: 10/699,190

(22) Filed: Oct. 31, 2003

(51) Int. Cl.
*F04B 1/04* (2006.01)
*F04B 1/12* (2006.01)

(52) U.S. Cl. ..... 417/273; 417/269

(58) Field of Classification Search ..... 417/273, 417/269; 91/472, 476, 491, 497, 499, 504; 137/909; 60/326
See application file for complete search history.

(56) References Cited

U.S. PATENT DOCUMENTS

| | | | | | |
|---|---|---|---|---|---|
| 944,913 | A * | 12/1909 | Rogers | 417/273 |
| 2,544,976 | A * | 3/1951 | Bevins | 417/273 |
| 2,651,258 | A | 9/1953 | Pierce | |
| 4,840,112 | A * | 6/1989 | Bhadra et al. | 91/459 |
| 5,158,109 | A * | 10/1992 | Hare, Sr. | 137/514.3 |
| 5,383,770 | A * | 1/1995 | Hisahara | 417/273 |
| 5,409,354 | A | 4/1995 | Stangroom | |
| 5,452,745 | A * | 9/1995 | Kordonsky et al. | 137/807 |
| 5,558,003 | A * | 9/1996 | Bauzou et al. | 91/492 |
| 5,967,018 | A * | 10/1999 | Breveglieri | 92/12.1 |
| 6,149,391 | A * | 11/2000 | Pohl et al. | 417/48 |
| 6,378,413 | B1 * | 4/2002 | Hoxie | 92/12.2 |
| 6,537,040 | B2 * | 3/2003 | Herrmann et al. | 417/273 |
| 6,823,895 | B2 * | 11/2004 | Hitchcock et al. | 137/827 |
| 2002/0011358 | A1 * | 1/2002 | Wassell | 175/73 |
| 2002/0176788 | A1 * | 11/2002 | Moutafis et al. | 417/415 |
| 2002/0179145 | A1 * | 12/2002 | Hitchcock et al. | 137/251.1 |
| 2003/0110935 | A1 * | 6/2003 | Nippert | 91/476 |

* cited by examiner

*Primary Examiner*—Anthony D. Stashick
*Assistant Examiner*—Jessica L Frantz

(57) ABSTRACT

A positive displacement piston unit is provided that utilizes a magnetorheological (MR) or electrorheological (ER) fluid as the transmission fluid. Each cylinder of the invention has an intake port connected to the suction port of the hydrostatic pump and an output port connected to the pressure port. Flow of the transmission fluid through the cylinder is controlled by an electromagnet or electrode located in close proximity to the intake and output ports of the cylinder. By energizing the electromagnet or electrode, the viscosity of the transmission fluid can be increased such that the portion of the fluid immediately near the electromagnet or electrode substantially solidifies. The solidified portion of the transmission fluid disables fluid through the particular passage, thereby restricting flow of the transmission fluid to the cylinder. As such, the present invention does not require the use of mechanical cylinder valves to control the flow of the transmission fluid.

13 Claims, 4 Drawing Sheets

SPECIAL FLUIDS FOR USE IN A HYDROSTATIC TRANSMISSION

BACKGROUND OF THE INVENTION

Positive displacement piston pumps are well known in the art. Typically, piston pumps are comprised of a plurality of cylinders containing pistons that travel in and out of the cylinder bores. The cylinders are in fluid communication with the pump's intake or suction port as well as the pump's output or pressure port. The cylinders have mechanical valving to enable or disable the flow from either the pump's suction or pressure ports. Two types of mechanical valving are well known in positive displacement piston pumps. An example of the first type of mechanical valving is a valve plate which will enable the required timing of fluid communication as a cylinder block rotates. The second type of mechanical valving comprises check valves. In a positive displacement piston pump utilizing check valves, the check valves alternately open and close to allow fluid into and out of the piston bores, as the pistons reciprocate into and out of the cylinder bores, thus performing the pumping function.

One disadvantage of the mechanical valves used to control the flow of transmission fluid through cylinders of conventional piston pumps is that they comprise many moving parts. Typical check valves include moving poppets and springs, all of which add to the cost of the piston pump. Further, these components can degrade over time, causing inefficient pump performance or failure. As such, there is a need in the art for a positive displacement piston unit that does not rely on conventional mechanical valving, thereby minimizing cost, improving reliability, and for other useful purposes.

Magnetorheological (MR) and electrorheological (ER) fluids have often been used in various pumping capacities, as disclosed in U.S. Pat. No. 2,651,258 to Pierce. MR fluids are those that change viscosity or even substantially solidify in the presence of a magnetic field. ER fluids behave similarly in the presence of an electric field. Because of their characteristics, MR and ER fluids have been used as transmission fluids as in Pierce, without the need for mechanical valves to control their flow. These fluids have commonly been used in brake systems as well as the active fluid in shock absorbers. To a much more limited extent, these fluids also have been used with piston pumps, as disclosed in U.S. Pat. No. 5,409,354 to Stangroom. Stangroom teaches the use of ER fluids in a mechanism triggering the opening and closing of a check valve. Stangroom does not, however, teach the use of MR and ER fluids as transmission fluids.

It is therefore a principle object of this invention is to provide cylinder valves that utilize a minimum number of moving parts and resist wear over the life of a positive displacement piston unit.

A further object of this invention is to provide a positive displacement piston unit that employs magnetorheological or electrorheological fluids to control the operation of the cylinder pistons and the hydraulic power transmission of the piston unit.

These and other objects will be apparent to those skilled in the art.

BRIEF SUMMARY OF THE INVENTION

The present invention consists of a positive displacement piston unit that utilizes a magnetorheological (MR) or electrorheological (ER) fluid as the transmission fluid. Each cylinder of the present invention has an intake port in fluid communication with the suction port of the pump as well as an output port connected to the pressure port of the hydraulic pump.

In one embodiment of the present invention, MR fluid is used as the active transmission fluid. Flow of the MR fluid through the cylinder is controlled by electromagnets located in close proximity to the intake and output ports of the cylinder. By energizing the electromagnet, the viscosity of the MR fluid can be increased such that the portion of the fluid immediately near the electromagnet substantially solidifies. The solidified portion of the MR fluid disables fluid through the particular passage, thereby restricting flow of the MR fluid to the cylinder.

In another embodiment of the present invention, ER fluid is used as the active transmission fluid. Flow of the ER fluid through the cylinder is controlled by electrodes located in close proximity to the intake and output ports of the cylinder. Just as with the MR fluid system, energizing the electrode can substantially solidify the portion of the ER fluid near the electrode, effectively disabling the flow of the ER fluid through the particular passage.

In either embodiment of the present invention, the MR or ER fluid serves as the transmission fluid, transmitting power hydraulically from a positive displacement piston pump to a positive displacement piston motor, or to any other device capable of using hydraulic power. Further, the characteristics of the MR or ER fluid can be used to enable or disable the flow of the transmission fluid into or out of the cylinder. As such, the present invention does not require the use of mechanical valves to control the flow of the transmission fluid.

DESCRIPTION OF THE INVENTION

Figure 1:
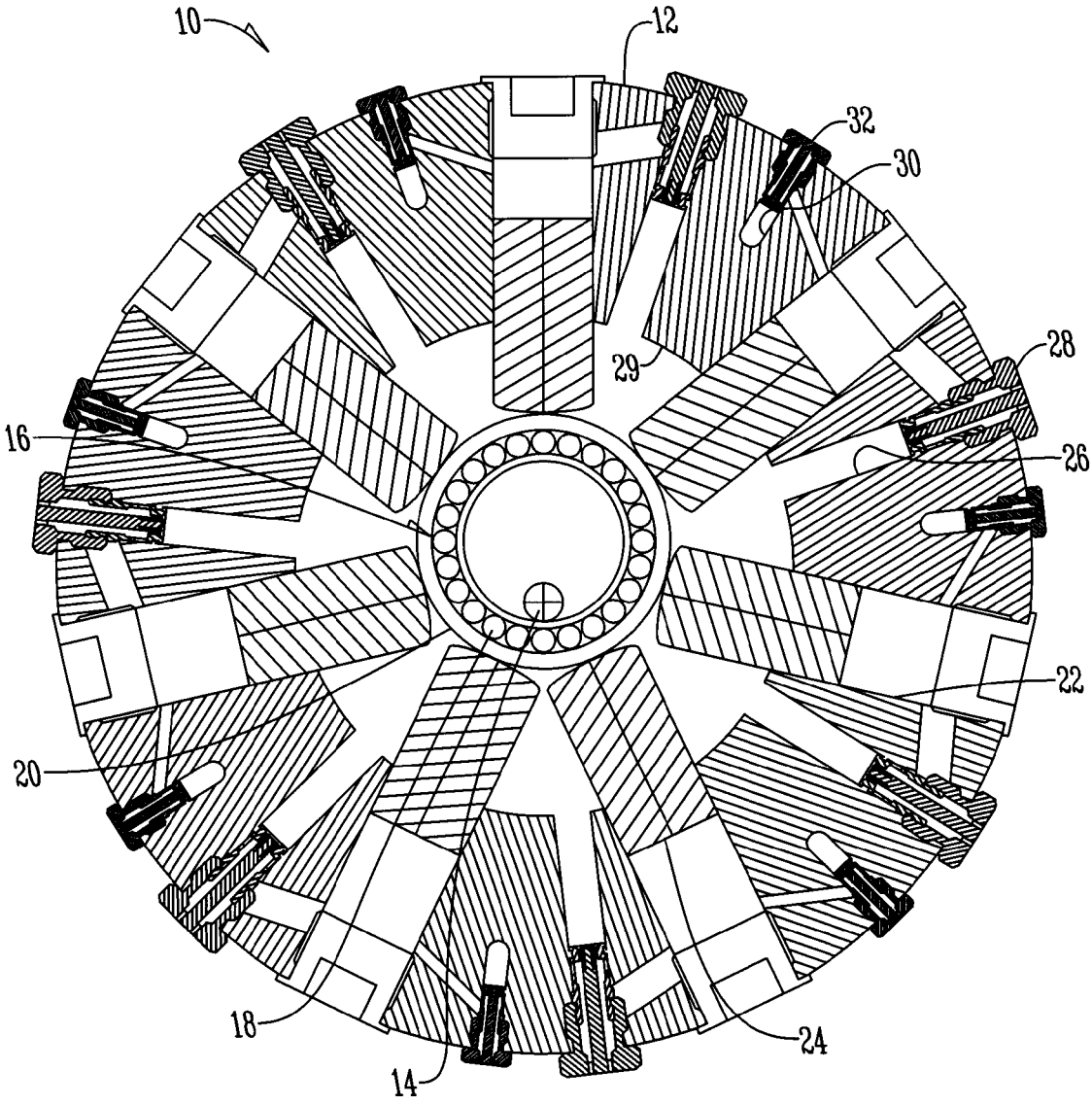
FIG. 1 is a perspective drawing of a radial piston pump of the present invention adapted for use with magnetorheological valving.

With respect to FIG. 1, a positive displacement piston unit 10 is shown adapted for use with MR transmission fluid. It should also be noted that the piston unit 10 may be a hydraulic pump or a motor. As shown in FIG. 1, the piston pump 10 may be arranged in a radial configuration. Alternatively, the piston pump 10 may be arranged in an axial or bent axis configuration, as is common in the art.

The piston pump 10 includes a housing 12 and a drive shaft 14. A bearing 16 is eccentrically mounted on shaft 14 and includes rolling elements 18 retained within an outer race 20. Bearing 16 is an antifriction bearing such as a ball bearing or a roller bearing, and rolling elements 18 comprise ball bearings or rollers. Housing 12 includes a plurality of bores 22. Cylinder pistons 24 fit within the bores 22 and ride against the outer race 20 of bearing 16. As the pump shaft 14 rotates, the eccentric bearing 16 gyrates about shaft 14, causing the pistons 24 to reciprocate in and out of the bores 22. This reciprocating motion of the pistons 24 draws fluid in through inlets 26, past valves 28, and into the bores 22. Fluid then leaves bores 22 through outlets 30 and past valves 32. An electronic controller (not shown) is associated with the pump shaft 14 and the valves 28 and 32, opening and closing check valves 28 and 32 as the shaft 14 rotates and drives the pistons 24 in and out of the bores 22.

As shown in FIG. 1 the pump shaft 14 and eccentric bearing 16 are disposed within a radial bore 29 within the housing 12. Additionally, the pistons 24 are disposed through the piston bores 26 and into the radial bore 29 to engage the outer race 20 of eccentric bearing 16. The inlets 26 are in fluid communication with the radial bore 29 such that fluid within the radial bore 29 flows directly into the inlets 26 into valve 28.

Figure 2:
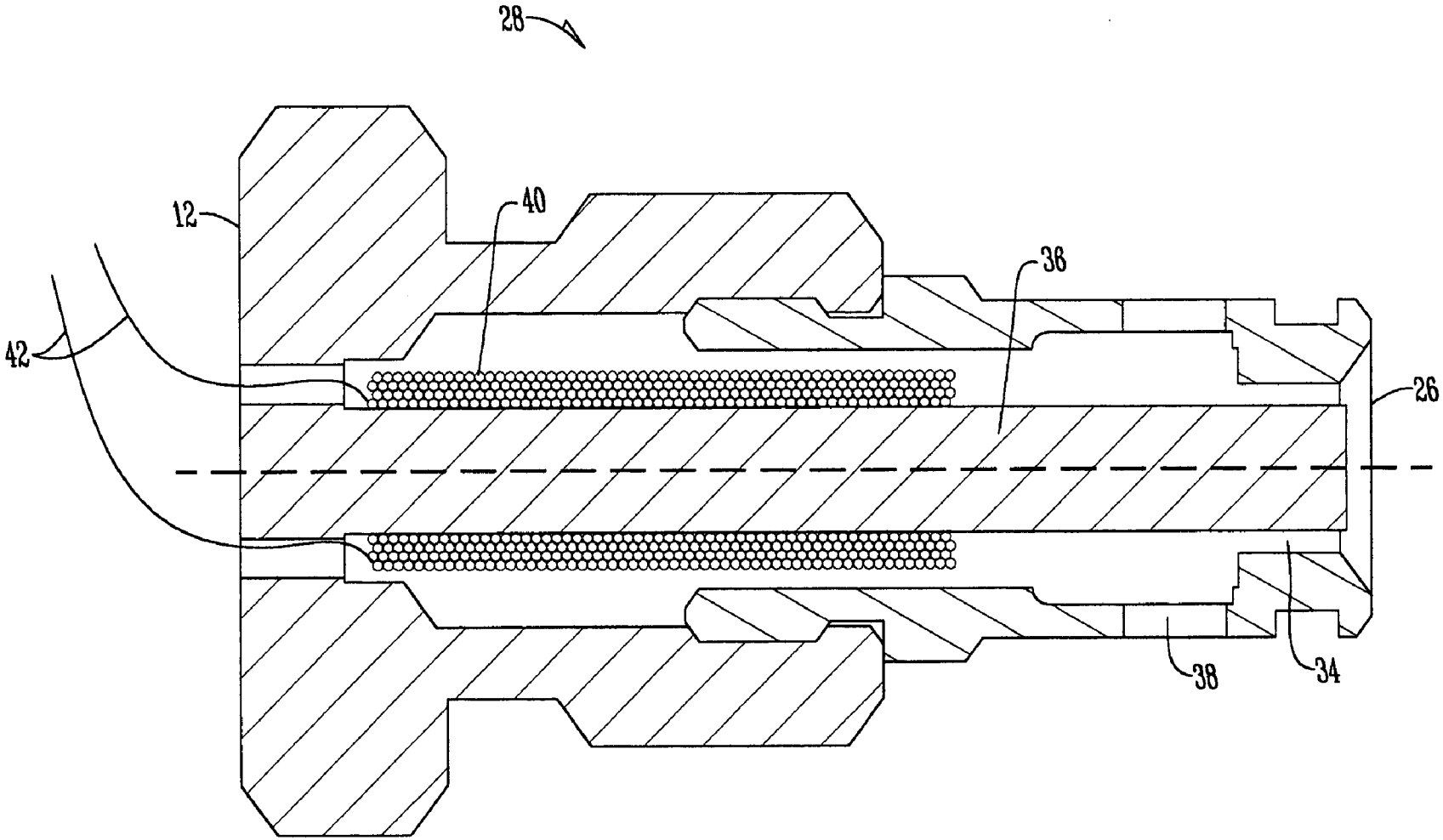
FIG. 2 is a cross sectional view of a valve adapted for use with magnetorheological transmission fluid for use in a piston pump of the present invention.

Valves 28 and 32 operate in much the same manner. The valves 28 and 32 may be adapted for use with MR fluid, as shown in FIG. 2. Valve 28 includes a channel 34 formed between an electromagnet 36 and the housing 12. Channel 34 is in fluid communication with the bore inlet 26 and a valve outlet 38. A solenoid coil 40 encircles electromagnet 36 and is operatively connected to an electronic controller (not shown) via wires 42. The electromagnet 36 and solenoid coil 40 serves as the electro-energized field generating element, which creates a magnetic field 44 as described hereafter. It should be noted that the term "electro-energized field generating element" is a generic term that refers to both magnetic and electric fields.

Figure 3:
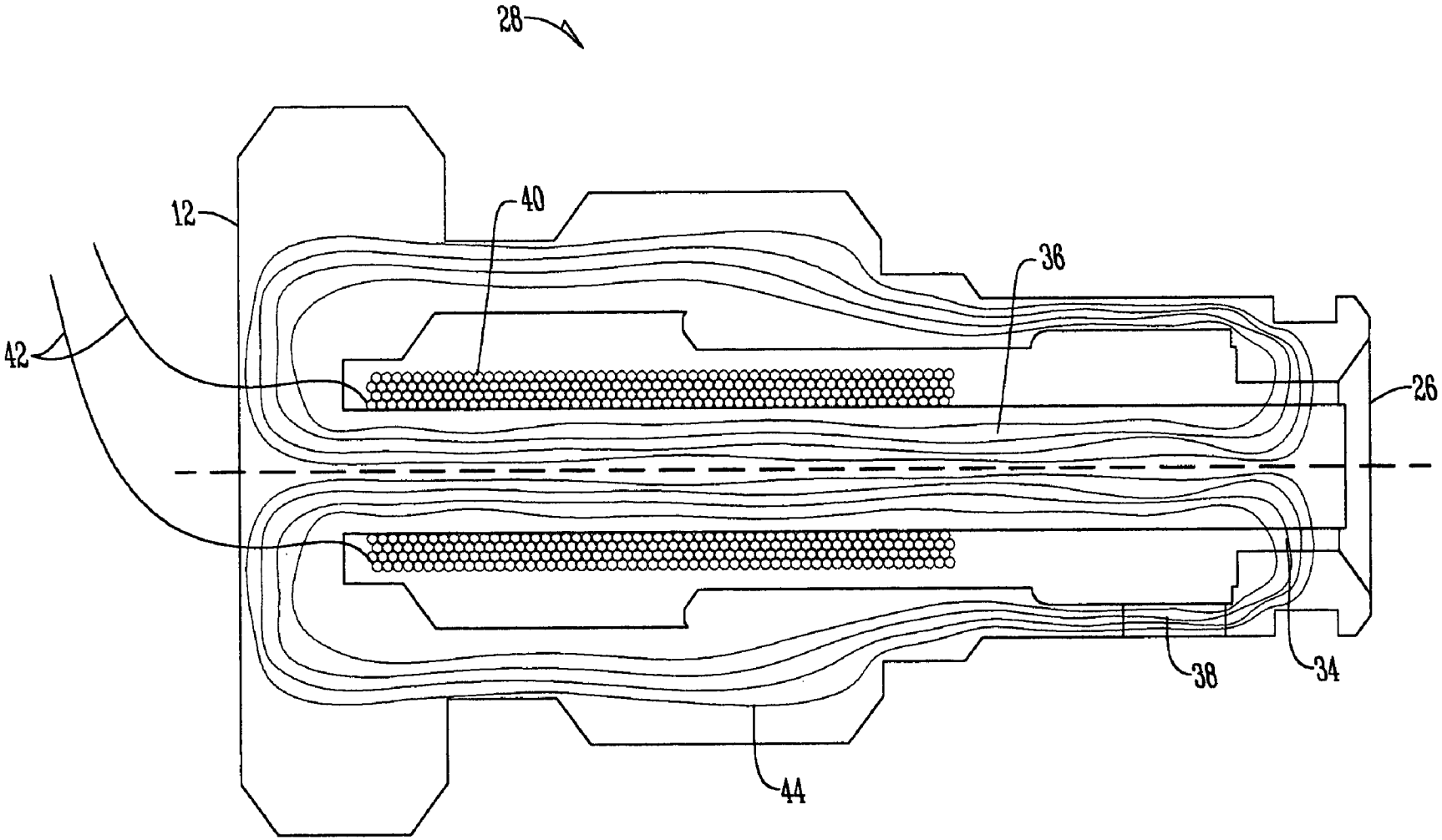
FIG. 3 is a cross sectional view of the valve of FIG. 2 together with a depiction of the magnetic field lines which are present when the valve is energized.

When the solenoid coil 40 is energized by the controller, a magnetic field 44 is created, as shown in FIG. 3. The magnetic field 44 is concentrated across the channel 34, causing the MR fluid within the channel 34 to substantially solidify. As the MR fluid solidifies, MR fluid within the bore inlet 26 cannot move through the channel 34 and into the bore 22. In essence, the presence of the magnetic field 44 works to close off the valve 28, preventing the MR fluid from flowing out of valve outlet 38. When the solenoid coil 40 is de-energized, the magnetic field 44 dissipates, allowing the MR fluid to again flow through channel 34 and past outlet 38.

Figure 4:
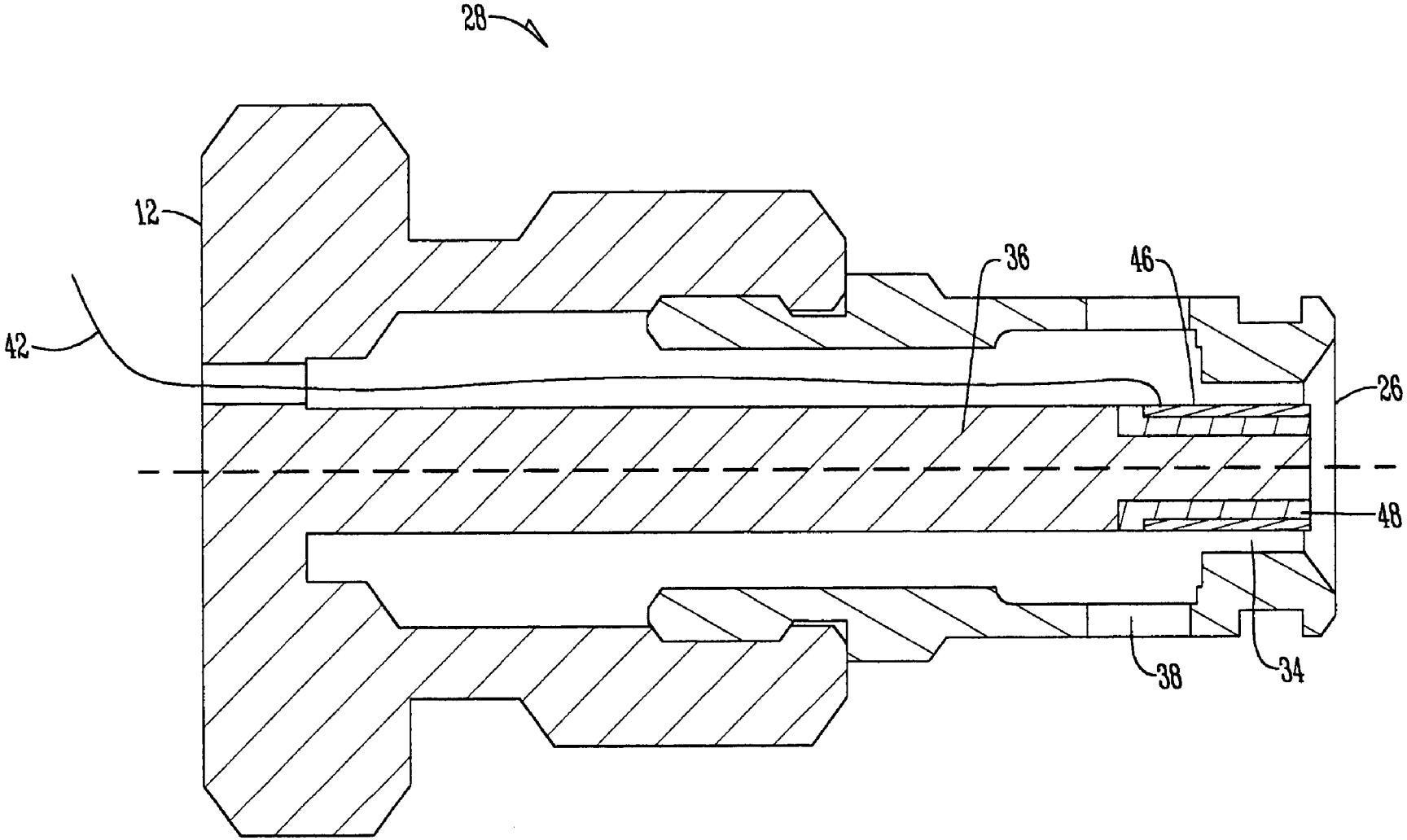
FIG. 4 is a cross sectional view of a valve adapted for use with electrorheological transmission fluid for use in a piston pump of the present invention.

Alternatively, the valves 28 and 32 may be adapted for use with ER fluid, as shown in FIG. 4. In this configuration, an electrode 46 is used as the electro-energized field generating element in place of the solenoid coil 40. The electrode 46 is mounted on an insulation strip 48 and connected to an electronic controller (not shown) via wire 42. When the electrode is energized, an electric field (not shown) is concentrated across the channel 34, causing the ER fluid within the channel 34 to substantially solidify. As the ER fluid solidifies, ER fluid within the bore inlet 26 cannot move through the channel 34 and into the bore 22. In essence, the presence of the electric field works to close off the valve 28, preventing the ER fluid from flowing out of valve outlet 38. When the electrode 46 is de-energized, the electric field dissipates, allowing the ER fluid to again flow through channel 34 and past outlet 38.

In operation, the drive shaft 14 rotates, causing the eccentric bearing 16 to gyrate and drive the pistons 24 in and out of the bores 22. As the piston 24 moves out of the bore 22, an electronic controller (not shown) de-energizes valve 28 such that the rheological transmission fluid may pass through inlet 26 and into the bore 22. At the same time, the electronic controller energizes valve 32 such that the rheological transmission fluid does not pass through the outlet 30. As the piston 24 moves into the bore 22, the electronic controller de-energizes valve 32, allowing the rheological transmission fluid to pass through the outlet 30. At the same time, the electronic controller energizes valve 28, thereby preventing flow of the rheological fluid from the inlet 26 past valve 28. In a piston unit 10 adapted for use with magnetorheological transmission fluid, valves 28 and 32 are equipped with solenoid coils 40 to produce a magnetic field 44 that substantially solidifies the MR fluid. Alternatively, in a piston unit 10 adapted for use with electrorheological transmission fluid, valves 28 and 32 are equipped with electrodes 46 to produce an electric field that substantially solidifies the ER fluid.

Those skilled in the art will appreciate that the same unit can be used as either a hydraulic pump or as a hydraulic motor by simply applying voltage to the valving at the desired times during shaft rotation.

Those skilled in the art also will appreciate that the unit of the present invention can be used as a variable displacement pump in at least two ways. First, the electronic controller can selectively refrain from enabling the outlet flow from some portion of the pistons. By not enabling the unit to pump with all pistons, or by not allowing the unit to motor with all pistons, the fluid from the selected pistons will not be pumped or motored and the piston unit's displacement will be reduced. Second, it is also possible to energize an inlet valve and de-energize an outlet valve at a variable point in time as a piston travels back into its bore. In this manner, a portion of the displacement of the piston will serve to push fluid back into the inlet passage rather than through the outlet passage. At the desired point during piston travel, the valve states will be switched and the remaining portion of the stroke will displace fluid to the outlet port. In this manner, flow is also reduced.

It is therefore seen that by the use of a rheological transmission fluid to control the communication of fluid into and out of cylinder bores, this invention permits the efficient operation of a positive displacement piston unit without the need for mechanical valving.

What is claimed is:

1. A positive displacement piston unit comprising:

a housing having a radial bore disposed therein;

a plurality of cylinder bores within the housing, each bore having a top end opposite a bottom end with a piston traveling therebetween;

each said piston extending into the radial bore;

first and second fluid passages connected to the top end and the bottom end of each bore;

a first electro-energized field generating element associated with the first fluid passage;

a second electro-energized field generating element associated with the second fluid passage;

a rheological fluid disposed within the fluid passages wherein the rheological fluid drives the cylinder pistons; and an inlet fluidly connecting the radial bore to the first electro-energized field generating element wherein fluid from the radial bore flows directly into the inlet.

2. The piston unit of claim 1 wherein the viscosity of the rheological fluid increases in the presence of a magnetic field.

3. The piston unit of claim 1 wherein the viscosity of the rheological fluid increases in the presence of an electric field.

4. The piston unit of claim 1 wherein the electro-energized field generating element comprises an electromagnet.

5. The piston unit of claim 1 wherein the electro-energized field generating element comprises an electrode.

6. The piston unit of claim 1 wherein the pistons are arranged in a radial configuration.

7. The piston unit of claim 1 further comprising a hydraulic pump.

8. The piston unit of claim 1 further comprising a hydraulic motor.

9. The piston unit of claim 1 further comprising an electronic controller to control the energizing and de-energizing of the electro-energized field generating element.

10. The piston unit of claim 9 wherein the controller selectively energizes and de-energizes the electro-energized field generating element to reduce flow of the rheological fluid through the fluid passages.

11. The piston unit of claim 9 wherein the controller selectively energizes the electro-energized field generating element associated with one cylinder and de-energizes the electro-energized field generating element associated with an adjacent cylinder to reduce flow of the rheological fluid through the piston unit.

12. The piston unit of claim 1 further comprising:

an inlet fluidly associated with the first electro-energized field generating element and the piston such that when the piston reciprocates, fluid outside the bore passes from the inlet through the electro-energized field generating element to the first fluid passageway and into the bore.

13. The piston unit of claim 12 further comprising an outlet associated with the second electro-energized field generating element such that fluid passes from the bore through the second fluid passage to the second electro-energized field generating element to the outlet.

* * * * *